US012799654B2

(12) United States Patent
Jones et al.

(10) Patent No.: US 12,799,654 B2
(45) Date of Patent: Nov. 17, 2026

(54) BALANCING YARN USE IN TUFTED PATTERN DESIGNS FOR TEXTILES

(71) Applicant: Interface, Inc., Atlanta, GA (US)

(72) Inventors: William Nathan Jones, LaGrange, GA (US); Jorge David Del Angel, LaGrange, GA (US); Graeme Robert Ripley, Peachtree City, GA (US)

(73) Assignee: INTERFACE, INC., Atlanta, GA (US)

( * ) Notice: Subject to any disclaimer, the term of this patent is extended or adjusted under 35 U.S.C. 154(b) by 0 days.

(21) Appl. No.: 18/958,843

(22) Filed: Nov. 25, 2024

(65) Prior Publication Data

US 2025/0171942 A1 May 29, 2025

Related U.S. Application Data

(60) Provisional application No. 63/603,290, filed on Nov. 28, 2023.

(51) Int. Cl.

| | |
|---|---|
| ***D05C 15/32*** | (2006.01) |
| ***D05C 15/16*** | (2006.01) |
| ***D05C 15/26*** | (2006.01) |

(52) U.S. Cl.

CPC ..... *D05C 15/26* (2013.01); *D05C 15/16* (2013.01)

(58) Field of Classification Search

CPC ..... D05C 15/26; D05C 15/20; D05C 15/10; D05C 15/32

See application file for complete search history.

(56) References Cited

U.S. PATENT DOCUMENTS

| | | | | |
|---|---|---|---|---|
| 3,850,783 | A * | 11/1974 | Peters | D05C 17/026 156/72 |
| 4,103,629 | A * | 8/1978 | Card | D05C 15/36 112/80.51 |
| 5,058,518 | A | 10/1991 | Card et al. | |
| 6,244,203 | B1 | 6/2001 | Morgante et al. | |
| 6,877,449 | B2 * | 4/2005 | Morgante | D05C 17/02 112/80.23 |

(Continued)

FOREIGN PATENT DOCUMENTS

| | | |
|---|---|---|
| EP | 2077348 A1 | 7/2009 |
| EP | 3426835 B1 | 4/2020 |

(Continued)

OTHER PUBLICATIONS

PCT/US2024/057309, "Invitation to Pay Additional Fees and, Where Applicable, Protest Fee", Feb. 17, 2025, 14 pages.

(Continued)

*Primary Examiner* — Tajash D Patel

(74) *Attorney, Agent, or Firm* — Kilpatrick Townsend & Stockton LLP

(57) ABSTRACT

A method includes accessing an electronic representation of a pattern design for controlling a carpet tufting operation, the pattern design including a pile height per tuft. The method also includes determining ranges of a plurality of pile heights identified in the pattern design. Additionally, the method includes determining individual pile heights of the plurality of pile heights of the pattern design using the ranges of the plurality of pile heights to manage material variance. Further, the method includes modifying the pattern design with the individual pile heights.

20 Claims, 8 Drawing Sheets

(56) References Cited

U.S. PATENT DOCUMENTS

| | | | | |
|---|---|---|---|---|
| 7,130,711 | B2 * | 10/2006 | Dabrowa | D05C 15/34 700/131 |
| 8,141,505 | B2 | 3/2012 | Hall et al. | |
| 8,155,776 | B2 | 4/2012 | Bittner et al. | |
| 8,240,263 | B1 * | 8/2012 | Frost | D05C 15/30 112/475.23 |
| 8,347,800 | B1 | 1/2013 | Machell-Archer et al. | |
| 8,430,043 | B2 | 4/2013 | Vaughan et al. | |
| 9,708,739 | B2 * | 7/2017 | Hall | D05C 15/36 |
| 9,850,607 | B2 | 12/2017 | Jones et al. | |
| 9,915,017 | B2 | 3/2018 | Padgett et al. | |
| 10,087,561 | B2 | 10/2018 | Jones et al. | |
| 11,124,910 | B2 * | 9/2021 | Callewaert | D05C 15/32 |
| 12,173,439 | B2 * | 12/2024 | Hall | D05C 15/34 |
| 2003/0164130 | A1 | 9/2003 | Morgante et al. | |
| 2006/0149409 | A1 | 7/2006 | Dabrowa et al. | |
| 2007/0146140 | A1 | 6/2007 | Nagao et al. | |
| 2007/0272137 | A1 | 11/2007 | Christman et al. | |
| 2009/0205547 | A1 | 8/2009 | Hall et al. | |
| 2009/0260554 | A1 | 10/2009 | Hall et al. | |
| 2017/0260668 | A1 | 9/2017 | Jones et al. | |
| 2018/0073175 | A1 | 3/2018 | Jones et al. | |

FOREIGN PATENT DOCUMENTS

| | | | | |
|---|---|---|---|---|
| GB | 2319786 | A | 6/1998 | |
| JP | 2005240199 | A | 9/2005 | |
| WO | 2007146140 | A2 | 12/2007 | |
| WO | WO-2010144902 | A2 * | 12/2010 | D06N 7/00 |
| WO | 2017155619 | A1 | 9/2017 | |
| WO | WO-2026039688 | A1 * | 2/2026 | D05C 15/20 |

OTHER PUBLICATIONS

PCT/US2024/057309, "International Search Report and Written Opinion", mailed Apr. 7, 2025, 19 pages.

PCT/US2024/057309, "International Preliminary Report on Patentability", mailed Jun. 11, 2026, 12 pages.

* cited by examiner

Standard Use 0.400
0.700

| | | | | | | | | | |
|---|---|---|---|---|---|---|---|---|---|
| 0.700 | 0.400 | 0.700 | 0.700 | 0.700 | 0.400 | 0.400 | 0.400 | 0.700 | 0.400 |
| 0.700 | 0.400 | 0.700 | 0.700 | 0.700 | 0.400 | 0.400 | 0.400 | 0.700 | 0.400 |
| 0.700 | 0.400 | 0.700 | 0.700 | 0.700 | 0.400 | 0.400 | 0.400 | 0.700 | 0.400 |
| 0.700 | 0.400 | 0.400 | 0.700 | 0.700 | 0.400 | 0.400 | 0.400 | 0.700 | 0.400 |
| 0.700 | 0.400 | 0.400 | 0.700 | 0.700 | 0.400 | 0.400 | 0.400 | 0.700 | 0.400 |
| 0.700 | 0.400 | 0.400 | 0.700 | 0.700 | 0.400 | 0.400 | 0.400 | 0.400 | 0.400 |
| 0.700 | 0.400 | 0.400 | 0.700 | 0.400 | 0.400 | 0.400 | 0.400 | 0.400 | 0.400 |
| 0.700 | 0.400 | 0.400 | 0.700 | 0.400 | 0.400 | 0.400 | 0.400 | 0.400 | 0.400 |
| 0.700 | 0.700 | 0.400 | 0.700 | 0.400 | 0.700 | 0.400 | 0.400 | 0.400 | 0.700 |
| 0.700 | 0.700 | 0.400 | 0.700 | 0.400 | 0.700 | 0.400 | 0.400 | 0.400 | 0.700 |
| 0.400 | 0.700 | 0.400 | 0.700 | 0.400 | 0.700 | 0.400 | 0.400 | 0.400 | 0.700 |
| 0.400 | 0.700 | 0.400 | 0.700 | 0.400 | 0.700 | 0.400 | 0.400 | 0.400 | 0.700 |
| 0.400 | 0.700 | 0.400 | 0.700 | 0.400 | 0.700 | 0.400 | 0.400 | 0.400 | 0.700 |
| 0.400 | 0.700 | 0.400 | 0.700 | 0.400 | 0.700 | 0.400 | 0.700 | 0.400 | 0.700 |
| 0.700 | 0.700 | 0.400 | 0.700 | 0.400 | 0.700 | 0.400 | 0.700 | 0.400 | 0.700 |
| 0.700 | 0.700 | 0.400 | 0.700 | 0.400 | 0.700 | 0.400 | 0.700 | 0.700 | 0.700 |
| 0.700 | 0.700 | 0.400 | 0.700 | 0.400 | 0.700 | 0.400 | 0.700 | 0.700 | 0.700 |
| 0.700 | 0.400 | 0.700 | 0.700 | 0.400 | 0.700 | 0.400 | 0.700 | 0.700 | 0.700 |
| 0.700 | 0.400 | 0.700 | 0.700 | 0.400 | 0.700 | 0.400 | 0.700 | 0.700 | 0.700 |
| 0.700 | 0.400 | 0.700 | 0.700 | 0.400 | 0.700 | 0.400 | 0.700 | 0.400 | 0.700 |
| 0.700 | 0.400 | 0.700 | 0.700 | 0.400 | 0.700 | 0.700 | 0.700 | 0.400 | 0.700 |
| 0.700 | 0.400 | 0.400 | 0.700 | 0.400 | 0.700 | 0.700 | 0.700 | 0.400 | 0.700 |
| 0.400 | 0.400 | 0.400 | 0.700 | 0.400 | 0.700 | 0.700 | 0.700 | 0.400 | 0.400 |
| 0.400 | 0.400 | 0.400 | 0.700 | 0.400 | 0.700 | 0.700 | 0.700 | 0.400 | 0.400 |
| 0.400 | 0.400 | 0.400 | 0.400 | 0.400 | 0.700 | 0.700 | 0.700 | 0.400 | 0.400 |
| 0.400 | 0.400 | 0.400 | 0.400 | 0.700 | 0.700 | 0.700 | 0.400 | 0.400 | 0.400 |
| 0.700 | 0.400 | 0.400 | 0.400 | 0.700 | 0.700 | 0.700 | 0.400 | 0.700 | 0.400 |
| 0.700 | 0.400 | 0.400 | 0.400 | 0.700 | 0.700 | 0.700 | 0.400 | 0.700 | 0.700 |
| 0.700 | 0.400 | 0.400 | 0.400 | 0.700 | 0.700 | 0.400 | 0.400 | 0.700 | 0.700 |
| 0.700 | 0.400 | 0.400 | 0.400 | 0.700 | 0.700 | 0.400 | 0.400 | 0.700 | 0.700 |
| 0.700 | 0.400 | 0.700 | 0.700 | 0.700 | 0.700 | 0.400 | 0.400 | 0.700 | 0.700 |
| 0.700 | 0.400 | 0.700 | 0.700 | 0.700 | 0.700 | 0.400 | 0.400 | 0.700 | 0.700 |
| 0.700 | 0.700 | 0.700 | 0.700 | 0.700 | 0.700 | 0.400 | 0.400 | 0.400 | 0.700 |
| 0.700 | 0.700 | 0.700 | 0.700 | 0.400 | 0.700 | 0.400 | 0.400 | 0.400 | 0.700 |
| 0.700 | 0.700 | 0.700 | 0.700 | 0.400 | 0.700 | 0.400 | 0.400 | 0.700 | 0.700 |
| 0.700 | 0.700 | 0.400 | 0.700 | 0.400 | 0.400 | 0.400 | 0.400 | 0.700 | 0.700 |
| 0.700 | 0.700 | 0.400 | 0.700 | 0.400 | 0.400 | 0.400 | 0.700 | 0.700 | 0.700 |
| 0.700 | 0.700 | 0.400 | 0.700 | 0.400 | 0.400 | 0.400 | 0.700 | 0.700 | 0.700 |
| 0.700 | 0.700 | 0.400 | 0.700 | 0.400 | 0.400 | 0.400 | 0.700 | 0.400 | 0.700 |
| 0.700 | 0.700 | 0.400 | 0.700 | 0.400 | 0.400 | 0.400 | 0.700 | 0.400 | 0.700 |
| Total Pile Value per Needle | 25.600 | 21.100 | 19.600 | 26.200 | 20.200 | 24.100 | 18.400 | 20.800 | 21.700 | 24.100 |
| AVG Value | 22.180 | | | | | | | | |

FIG. 7

Optimized

| | Minimum | Maximum |
|---|---|---|
| | 0.300 | 0.500 |
| | 0.600 | 0.800 |

| | | | | | | | | | | |
|---|---|---|---|---|---|---|---|---|---|---|
| | 0.650 | 0.400 | 0.750 | 0.600 | 0.750 | 0.300 | 0.475 | 0.440 | 0.710 | 0.370 |
| | 0.650 | 0.400 | 0.750 | 0.600 | 0.750 | 0.300 | 0.475 | 0.440 | 0.710 | 0.370 |
| | 0.600 | 0.410 | 0.750 | 0.600 | 0.750 | 0.300 | 0.475 | 0.440 | 0.750 | 0.400 |
| | 0.600 | 0.410 | 0.460 | 0.600 | 0.750 | 0.300 | 0.500 | 0.420 | 0.710 | 0.350 |
| | 0.600 | 0.420 | 0.475 | 0.600 | 0.750 | 0.300 | 0.500 | 0.430 | 0.710 | 0.350 |
| | 0.600 | 0.420 | 0.475 | 0.600 | 0.750 | 0.300 | 0.500 | 0.430 | 0.410 | 0.350 |
| | 0.600 | 0.420 | 0.475 | 0.600 | 0.450 | 0.300 | 0.500 | 0.430 | 0.410 | 0.350 |
| | 0.600 | 0.400 | 0.475 | 0.600 | 0.450 | 0.300 | 0.500 | 0.430 | 0.410 | 0.350 |
| | 0.600 | 0.700 | 0.475 | 0.600 | 0.450 | 0.680 | 0.500 | 0.420 | 0.410 | 0.650 |
| | 0.600 | 0.750 | 0.475 | 0.600 | 0.450 | 0.680 | 0.500 | 0.420 | 0.410 | 0.650 |
| | 0.300 | 0.750 | 0.475 | 0.600 | 0.450 | 0.680 | 0.500 | 0.420 | 0.410 | 0.650 |
| | 0.300 | 0.750 | 0.475 | 0.600 | 0.450 | 0.680 | 0.500 | 0.420 | 0.410 | 0.650 |
| | 0.300 | 0.750 | 0.475 | 0.600 | 0.450 | 0.680 | 0.500 | 0.410 | 0.410 | 0.650 |
| | 0.300 | 0.750 | 0.475 | 0.600 | 0.450 | 0.680 | 0.500 | 0.750 | 0.410 | 0.650 |
| | 0.600 | 0.750 | 0.475 | 0.600 | 0.450 | 0.680 | 0.500 | 0.750 | 0.410 | 0.650 |
| | 0.600 | 0.750 | 0.475 | 0.600 | 0.450 | 0.680 | 0.500 | 0.750 | 0.410 | 0.650 |
| | 0.600 | 0.700 | 0.475 | 0.600 | 0.450 | 0.680 | 0.500 | 0.750 | 0.410 | 0.650 |
| | 0.600 | 0.400 | 0.750 | 0.600 | 0.450 | 0.680 | 0.400 | 0.750 | 0.710 | 0.650 |
| | 0.600 | 0.400 | 0.750 | 0.600 | 0.450 | 0.680 | 0.400 | 0.750 | 0.710 | 0.650 |
| | 0.600 | 0.410 | 0.750 | 0.600 | 0.450 | 0.680 | 0.475 | 0.750 | 0.410 | 0.600 |
| | 0.650 | 0.410 | 0.750 | 0.600 | 0.450 | 0.680 | 0.800 | 0.750 | 0.410 | 0.650 |
| | 0.650 | 0.400 | 0.475 | 0.600 | 0.450 | 0.680 | 0.800 | 0.750 | 0.410 | 0.650 |
| | 0.300 | 0.410 | 0.475 | 0.600 | 0.450 | 0.680 | 0.800 | 0.720 | 0.410 | 0.370 |
| | 0.300 | 0.410 | 0.475 | 0.600 | 0.450 | 0.680 | 0.800 | 0.720 | 0.410 | 0.350 |
| | 0.300 | 0.410 | 0.460 | 0.300 | 0.450 | 0.680 | 0.800 | 0.720 | 0.410 | 0.350 |
| | 0.300 | 0.410 | 0.460 | 0.300 | 0.750 | 0.680 | 0.800 | 0.410 | 0.410 | 0.350 |
| | 0.650 | 0.410 | 0.460 | 0.300 | 0.750 | 0.680 | 0.800 | 0.440 | 0.710 | 0.350 |
| | 0.650 | 0.410 | 0.460 | 0.300 | 0.750 | 0.670 | 0.800 | 0.440 | 0.720 | 0.650 |
| | 0.600 | 0.410 | 0.475 | 0.300 | 0.750 | 0.670 | 0.500 | 0.420 | 0.720 | 0.650 |
| | 0.600 | 0.420 | 0.460 | 0.300 | 0.750 | 0.670 | 0.500 | 0.420 | 0.720 | 0.650 |
| | 0.600 | 0.400 | 0.750 | 0.600 | 0.750 | 0.670 | 0.500 | 0.440 | 0.710 | 0.650 |
| | 0.600 | 0.400 | 0.750 | 0.600 | 0.750 | 0.670 | 0.500 | 0.430 | 0.740 | 0.650 |
| | 0.600 | 0.700 | 0.750 | 0.600 | 0.750 | 0.670 | 0.500 | 0.430 | 0.410 | 0.650 |
| | 0.670 | 0.750 | 0.750 | 0.600 | 0.450 | 0.670 | 0.500 | 0.430 | 0.410 | 0.650 |
| | 0.600 | 0.750 | 0.750 | 0.600 | 0.450 | 0.670 | 0.500 | 0.430 | 0.710 | 0.650 |
| | 0.600 | 0.750 | 0.475 | 0.600 | 0.450 | 0.300 | 0.500 | 0.420 | 0.720 | 0.650 |
| | 0.600 | 0.750 | 0.475 | 0.600 | 0.450 | 0.300 | 0.490 | 0.750 | 0.710 | 0.600 |
| | 0.600 | 0.750 | 0.460 | 0.600 | 0.450 | 0.300 | 0.480 | 0.750 | 0.710 | 0.650 |
| | 0.600 | 0.750 | 0.475 | 0.600 | 0.440 | 0.300 | 0.430 | 0.750 | 0.410 | 0.650 |
| | 0.650 | 0.700 | 0.460 | 0.600 | 0.440 | 0.300 | 0.430 | 0.750 | 0.410 | 0.650 |
| Total Pile Value per Needle | 22.180 | 22.180 | 22.180 | 22.200 | 22.180 | 22.180 | 22.180 | 22.180 | 22.180 | 22.180 |
| AVG Value | 22.182 | | | | | | | | | |

FIG. 8

BALANCING YARN USE IN TUFTED PATTERN DESIGNS FOR TEXTILES

CROSS-REFERENCE TO RELATED APPLICATIONS

This claims priority to U.S. Provisional Application No. 63/603,290, filed Nov. 28, 2023, entitled "BALANCING YARN USE IN TUFTED PATTERN DESIGNS FOR TEXTILES," the disclosure of which is hereby incorporated by reference in its entirety for all purposes.

TECHNICAL FIELD

The present disclosure relates generally to manufacturing and designing carpet and other types of textiles. More specifically, but not by way of limitation, this disclosure relates to automated pattern adjustment for carpet and other textiles to balance yarn use during manufacturing.

BACKGROUND

Carpet is typically formed by tufting a face cloth. In the case of carpet tiles, the face cloth may be attached to a stabilizing structural backing to form a carpet web that is then cut into carpet tiles of the desired shape and size.

Designs, patterns, and color may be imparted to the face cloth via a tufting operation. A tufting machine can include at least one needle bar with needles arranged across the bar. A colored yarn can be associated with each needle. A backing material is fed under the needle bar, which is reciprocated to drive the needles through and out of the backing material to form loops of yarn or "tufts" in the backing material. As this process continues, the tufts extend across the backing material in generally lateral rows and down the backing material in generally longitudinal columns to form the face cloth.

To impart designs on the face of the face cloth, the needle bar carrying the yarn-bearing needles is capable of limited lateral movement relative to the backing material that can shift the placement of tufts laterally across the backing material. The yarn fed to the needles can also be controlled to vary the height of the tufts placed in the backing. Moreover, both the rate at which the backing material moves relative to the needle bar as well as the rate at which the needle bar creates tufts in the backing material can be controlled to manage the density of the tufts in the face cloth.

In some tufting machines, multiple needle bars are used to enhance opportunities to create designs. Without these capabilities, the resulting product includes tufts extending in lines of a single color along the length of the backing material. To form a non-striped pattern with the tufts, the needle bar shifts laterally to vary the positioning of the different color tufts in the backing material and to vary the height of the tufts to form the desired design or pattern.

During the tufting process, yarn is continually fed to each needle on the needle bar. Prior to tufting, yarn of the desired color is wound onto a yarn package. A yarn package is prepared for each tufting needle. The yarn packages are then loaded on a creel and each yarn end associated with the intended needle on the needle bar. During use and as tufting proceeds, the yarn unwinds from the packages. In some examples, the yarn can be provided by a beam in place of, or in addition to, the creel. Further, in some tufting technologies and applications, more than one yarn end can be represented in the same needle, such as in "hollowed needle" technologies and in shag tufters.

It is difficult to gauge how much yarn each needle will need to create the desired pattern. Moreover, if a single yarn package is depleted during tufting, the entire tufting process must be stopped and the yarn package replaced before tufting can resume. Such a process is extremely time-and labor-intensive and expensive.

To avoid yarn packages from running out during tufting, the yarn packages are typically over-prepared, meaning that more yarn than will be necessary is provided on the package. Depending on the complexity of the pattern and diversity of yarn color used to create it, some yarn packages are over-prepared by as much as 85% to more than 200%. Moreover, the unused yarn remaining on the yarn packages after tufting must be spliced and repackaged. Yarn can only be wound onto and unwound from yarn packages so many times before it becomes unusable.

SUMMARY

Various aspects of the present disclosure provide systems and methods for balancing yarn use in tufted pattern designs. In an example, a method includes accessing an electronic representation of a pattern design for controlling a carpet tufting operation, the pattern design including a pile height per tuft. The method also includes determining ranges of a plurality of pile heights identified in the pattern design. Further, the method includes determining individual pile heights of the plurality of pile heights of the pattern design using the ranges of the plurality of pile heights to manage material variance. Additionally, the method includes modifying the pattern design with the individual pile heights.

In other aspects, a non-transitory, computer-readable medium stores program instructions that are executable by a processor for performing operations. The operations include accessing update data from prior updates to prior pattern designs. The operations also include training, using the update data, a machine-learning model to generate updated pattern designs. Further, the operations include accessing an electronic representation of a new pattern design for controlling a carpet tufting operation, the new pattern design including a pile height per tuft. Additionally, the operations include generating an updated new pattern design by applying the trained machine-learning model to the new pattern design, the updated new pattern design including an updated pile height per tuft.

In other aspects, system includes a processor and a memory device. The memory device includes program instructions that are executable by the processor to perform operations. The operations include accessing an electronic representation of a pattern design for controlling a carpet tufting operation, the pattern design including a pile height per tuft. Additionally, the operations include determining ranges of a plurality of pile heights identified in the pattern design. Further, the operations include determining individual pile heights of the plurality of pile heights of the pattern design using the ranges of the plurality of pile heights to manage material variance. Furthermore, the operations include modifying the pattern design with the individual pile heights.

This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

The foregoing, together with other features and examples, will become more apparent upon referring to the following specification, claims, and accompanying drawings.

BRIEF DESCRIPTION OF THE DRAWINGS

FIG. 7 is chart indicating pile heights of an initial carpet design according to some examples of the present disclosure.

FIG. 8 is a chart indicating optimized pile heights of the initial carpet design of FIG. 7 according some examples of the present disclosure.

DETAILED DESCRIPTION

Figure 1:
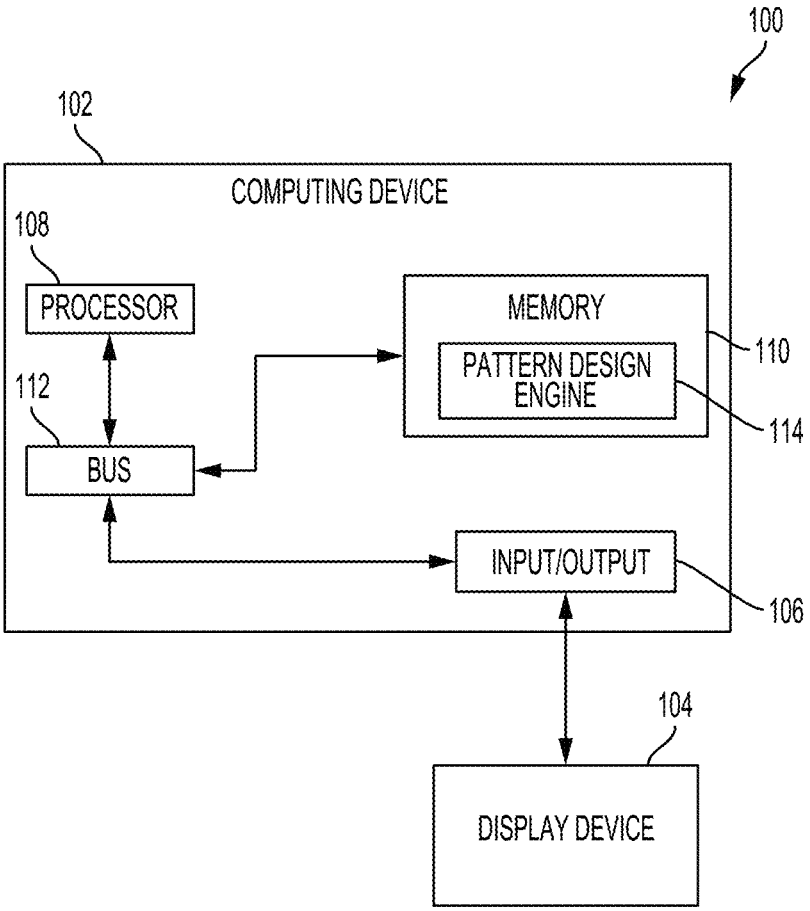
FIG. 1 is a block diagram of a computing system for facilitating yarn balancing in a carpet design according to some examples of the present disclosure.

Certain aspects and features relate to tools for pattern designers that manage and balance an amount of yarn used on every needle for a given pattern. The tools can adjust the pattern accordingly to balance the yarn usage on the needles. By way of example only, the tool can graphically represent the yarn use for each needle and display, in real time, changes in yarn usage based on changes that are made to the pattern. In some examples, the tool can automatically alter the design to affect more balanced yarn usage in ways that do no harm to the design intent (i.e., maintain the design integrity).

In an ideal scenario, all of the yarns would have the same yarn usage such that all of the yarn packages at the end of a tufting run would be empty. This result would simplify yarn package preparation (all of the packages would be prepared with the same amount of yarn) as well as eliminate the need to process (e.g., splice and re-package) any residual yarn after tufting is complete.

Perhaps less preferable but still advantageous would be designing patterns such that the same color of yarn has the same usage. For example, all of the blue yarn packages would be identical to all of the other blue yarn packages; all of the yellow yarn packages would be identical to all of the other yellow yarn packages, etc. Again, this would simplify the yarn package preparation process with the goal being to have an empty creel at the end of every run.

Advance knowledge of exactly how much yarn will be needed for each needle for a given tufting pattern can result in material savings (there is no need to over-prepare the yarn packages so one can purchase and keep less yarn in inventory), labor savings (less labor involved in preparing yarn packages), and time savings (less tufting shutdowns caused by yarn package depletion).

A system according to some examples can receive pile (or tuft) heights, stitch rates, and pattern repeats for a particular carpet design. Different colors on a user interface can represent different pile heights-a pile height value can be assigned to each color. A real-time graph can represent use-of-yarn per needle changes substantially contemporaneously to changes in the tuft height design. The real-time graph can be on the same user interface as the visual representation of the tuft height design.

For example, a pattern design for controlling a carpet tufting operation can be received or otherwise accessed in electronic form. The pattern design can include a pile height per tuft illustrated by colors or other visual representation cue. A grid can represent the tuft height pattern design with the visual cues. A graph can be included on the same user interface as the grid. The graph can represent the use-of-yarn per needle for the carpet tufting operation and a threshold that indicates a desired yarn-use across multiple needles for the carpet tufting operation. In some examples, the pile height can include a range of acceptable pile heights for the pile height identified per tuft to maintain the design effect of the pattern design. In response to receiving a change to a pile height of one or more tufts within the indicated range for the pattern design on the grid, the graph can be modified to illustrate a new use-of-yarn per needle that accounts for the change.

In some examples, the pile height values can be modified or an acceptable range for a pile height of a certain value can be changed. For example, the value may correspond to 5 millimeters (mm) and an acceptable range of tuft heights for that value can be 4 mm to 6 mm. In some examples, the acceptable range of tuft heights may subsequently be changed to 4.5 mm to 5.5 mm. The system may be able to select an exact value within the range for each stitch so that the use-of-yarn per needle does not deviate beyond the threshold. In other examples, the system can receive values per stitch within the range from a user and, in real time, display changes to yarn use per needle. The system may establish a buffer limit on the number of pile height values that are near the end of a range that is within a certain amount of another pile height value. On the user interface, different shades of the same color may visually represent variations in pile heights of the same value.

These illustrative examples are given to introduce the reader to the general subject matter discussed here and are not intended to limit the scope of the disclosed concepts. The following sections describe various additional features and examples with reference to the drawings in which like numerals indicate like elements, and descriptions of order are used to describe the illustrative aspects but, like the illustrative aspects, should not be used to limit the present disclosure.

FIG. 1 is a block diagram of an example of a computing system 100 for facilitating yarn balancing in a carpet design according to some aspects. The computing system 100 includes a computing device 102 and a display device 104 that can receive and display information from the computing device 102 through an input/output 106 in the computing device 102.

Examples of the computing device 102 include a laptop computer, a desktop computer, a server system, a smart phone, and a tablet. Examples of the display device 104 include a monitor, a television, an LCD display, and a projection system. In some examples, the computing device 102 includes the display device 104, rather than being separate devices as shown in FIG. 1. The input/output 106 can provide a wired or a wireless communication path for the computing device to communicate with external devices, such as the display device 104. Examples of the input/output 106 include a wireless transceiver, a serial port, a HDMI port, a USB port, and an Ethernet port.

The computing device 102 can also include a processor 108, a memory 110, and a bus 112. In some examples, some or all of the components shown in FIG. 1 can be integrated into a single structure, such as a single housing. In other examples, some or all of the components shown in FIG. 1 can be distributed (e.g., in separate housings) and in communication with each other.

The processor 108 can execute one or more operations for facilitating yarn balancing or even take-up in a carpet design and generate one or more user interfaces for display by the display device 104. The processor 108 can execute instructions stored in the memory 110 to perform the operations. The processor 108 can include one processing device or multiple processing devices. Examples of the processor 108 include a Field-Programmable Gate Array ("FPGA"), an application-specific integrated circuit ("ASIC"), and a microprocessor.

The processor 108 can be communicatively coupled to the memory 110 via the bus 112. The memory 110, which may be a non-volatile memory, can include any type of memory device that retains stored information when powered off. Examples of the memory 110 include electrically erasable and programmable read-only memory ("EEPROM"), flash memory, or any other type of non-volatile memory. At least some of the memory 110 can include a medium from which the processor 108 can read instructions. A computer-readable medium can include electronic, optical, magnetic, or other non-transitory storage devices capable of providing the processor 108 with computer-readable instructions or other program code. Examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The memory 110 can include instructions that form a pattern design engine 114 that, when executed by the processor 108, cause the computing device 102 to perform one or more operations for facilitating even take-up carpet design.

Figure 2:
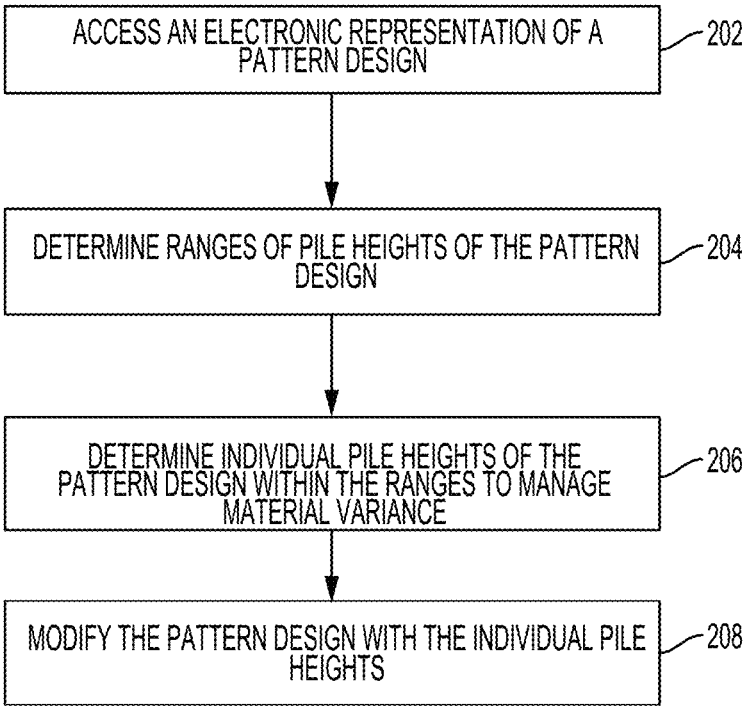
FIG. 2 is a flow chart of a process for facilitating yarn balancing in a carpet or other textile design according to some examples of the present disclosure.

FIG. 2 depicts a flow chart of a process for facilitating yarn balancing in a carpet or other textile design according to one aspect. The process of FIG. 2 is described with reference to the system 100 of FIG. 1, but other systems or devices, with hardware, software, or both, can be used instead.

In block 202, the computing device 102 accesses an electronic representation of a pattern design. The pattern design can be coded instructions for controlling a carpet tufting operation. The pattern design can include a pile height per tuft of the design. The pattern design can be received by the computing device 102 from one or more user inputs through an input device and on a graphical illustration displayed on the display device 104. For example, the computing device 102 can receive a designation of a pile height for at least some tuft markers of a grid shown on the display device as a selection of a value from available pile height values for the operation. In other examples, the pattern design can be received by the computing device 102 as a file from a separate computing system over a network, such as the Internet, or from a storage device, such as an optical disc or a flash drive, which can be coupled, or inserted in, to the computing device 102.

In block 204, the computing device 102 determines ranges of pile heights of the pattern design. In an example, the pile heights indicated in the pattern design may fall within pre-set ranges of pile heights that are acceptable for typical pattern designs. By way of example, the pile height ranges may be approximately 0.07 inches for a short pile height (e.g., a range of 0.280-0.350 inches), approximately 0.11 inches for a medium pile height (e.g., a range of 0.390 –0.500 inches), and approximately 0.140 for a long pile height (e.g., a range of 0.560-0.700 inches). Other default lengths may also be selected, and, in some examples, the acceptable pile height range may increase as the pile height increases (e.g., a larger range for long pile heights and a shorter range for short pile heights). Further, the ranges may be adjustable to larger or smaller ranges by the designer from default ranges that are initially identified for the pattern design.

In block 206, the computing device 102 determines individual pile heights of the pattern design within the determined ranges to manage material variance. For example, the computing device 102 may autonomously adjust the pile heights identified in the pattern design such that known yarn packages on a creel will be exhausted at approximately the same time. In some examples, adjusting the pile heights may involve increasing or deceasing a designed pile height within the determined range. Because an amount of yarn in the yarn packages is known, an optimization algorithm may be used to adjust the pile heights within their determined ranges such that the various yarn packages used in the pattern design are exhausted at approximately the same time. As used herein, the term approximately may refer to values within 10% of the related value. That is, if a first yarn package is exhausted, the remaining yarn packages on the same creel may have less than 10% of the original amount of yarn remaining in the yarn packages.

In block 208, the computing device 102 modifies the pattern design with the individual pile heights determined at block 206. In an example, the modified pattern design may result in changes to material usage demand (e.g., various colors of yarn) of a pattern without distorting the design in a fractured manner. Fractured designs may refer to a design with broken areas resulting in boundaries of a design that are no longer clearly recognized. While some fade may be experienced in the present design, the design integrity may be maintained.

Figure 3:
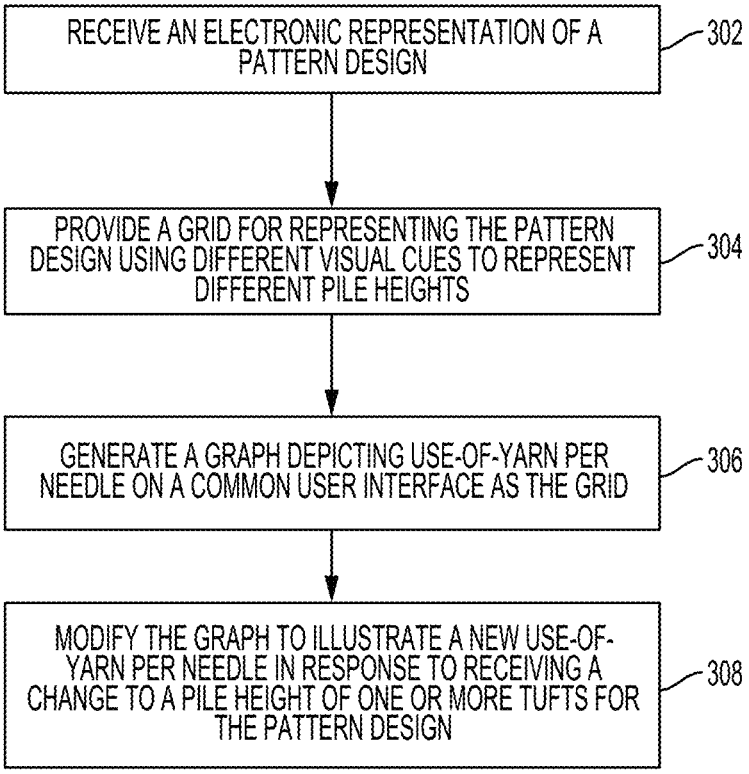
FIG. 3 is a flow chart of a process for facilitating even take-up carpet or other textile design according to some examples of the present disclosure.

FIG. 3 depicts a flow chart of a process for facilitating even take-up carpet or other textile design according to one aspect. The process of FIG. 3 is described with reference to the system 100 of FIG. 1, but other systems or devices, with hardware, software, or both, can be used instead.

In block 302, the computing device 102 receives an electronic representation of a pattern design. The pattern design can be coded instructions for controlling a carpet tufting operation. The pattern design can include a pile height per tuft of the design. The pattern design can be received by the computing device 102 from one or more user inputs through an input device and on a graphical illustration displayed on the display device 104. For example, the computing device 102 can receive a designation of a pile height for at least some tuft markers of a grid shown on the display device as a selection of a value from available pile height values for the operation. In other examples, the pattern design can be received by the computing device 102 as a file from a separate computing system over a network, such as the Internet, or from a storage device, such as an optical disc or a flash drive, which can be coupled, or inserted in, to the computing device 102.

In block 304, the computing device 102 provides a grid for display by the display device 104. The grid represents the pattern design using different visual cues to represent different pile heights. The grid can include columns and rows of tuft markers. Each tuft marker can correspond to a stitch of a tufting operation. Each column of tuft markers can be associated with a needle among multiple needles to be used in the tufting operation. The visual cues can include different colors that represent different pile-height values. In other examples, dashed or patterned cues are used to represent different pile-height values.

In block 306, the computing device 102 generates a graph that depicts use-of-yarn per needle on a common user interface as the grid. The graph may also depict a threshold that indicates a desired yarn-use across multiple needles for the tufting operation. The threshold may be a tolerance range for an acceptable deviation in yarn use across multiple needles for the tufting operation. The common user interface can include an interface that is displayable on the display device 104 such that the grid and the graph can be viewed at the same time on the display device 104.

In block 308, the computing device 102 modifies the graph to illustrate a new use-of-yarn per needle in response to receiving a change to a pile height of one or more tufts for the pattern design. The new use-of-yarn per needle can account for the change to the pile height in real time with respect to the change to the grid being made. The use-of-yarn per needle can predict an amount of yarn necessary for each needle to implement the pattern design through the carpet tufting operation.

Figure 4:
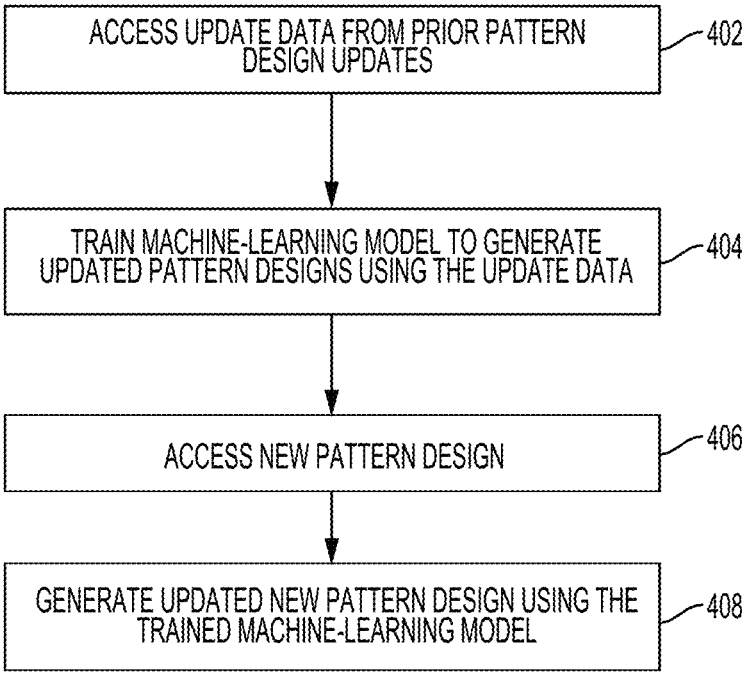
FIG. 4 is a flow chart of a process for generating updated pattern designs according to some examples of the present disclosure.

FIG. 4 depicts a flow chart of a process for generating updated pattern designs according to one aspect. The process of FIG. 4 is described with reference to the system 100 of FIG. 1, but other systems or devices, with hardware, software, or both, can be used instead.

In block 402, the computing device 102 accesses update data from prior pattern design updates. In an example, the update data may be data associated with updates to pattern designs generated by the processes of FIGS. 2 and 3. Other update data generated from other sources may also be used. The update data may include original pattern designs and updated pattern designs after the original pattern designs undergo a manual or automated optimization process to provide even take-up of the yarn packages of a creel.

In block 404, the computing device 102 trains a machine-learning model, using the update data of block 402, to generate updated pattern designs. The machine-learning model may be a supervised or semi-supervised machine-learning model that is trained for application to future pattern designs to select pile heights that achieve even take-up of yarn packages of a creel while maintaining design integrity. Examples of the machine-learning model can include a linear regression model, a logistic regression model, an artificial neural network, a decision tree, a random forest, or any other machine-learning model trainable to determine updated pile heights in an updated pattern design.

In block 406, the computing device 102 accesses a new pattern design. The new pattern design may be a pattern design generated by a designer that has not yet undergone an optimization process to ensure even take-up of the yarn packages. In an example, the new pattern design may be in a format similar to the format of the pattern designs used to train the machine-learning model at block 404.

In block 408, the computing device 102 applies the trained machine-learning model to the new pattern design to generate an updated pattern design. The updated pattern design may adjust the pile heights of the new pattern design to achieve even take-up of the yarn packages during a tufting operation. By achieving even take-up of the yarn packages, significant time and material waste may be avoided using the updated pattern design.

Figure 5:
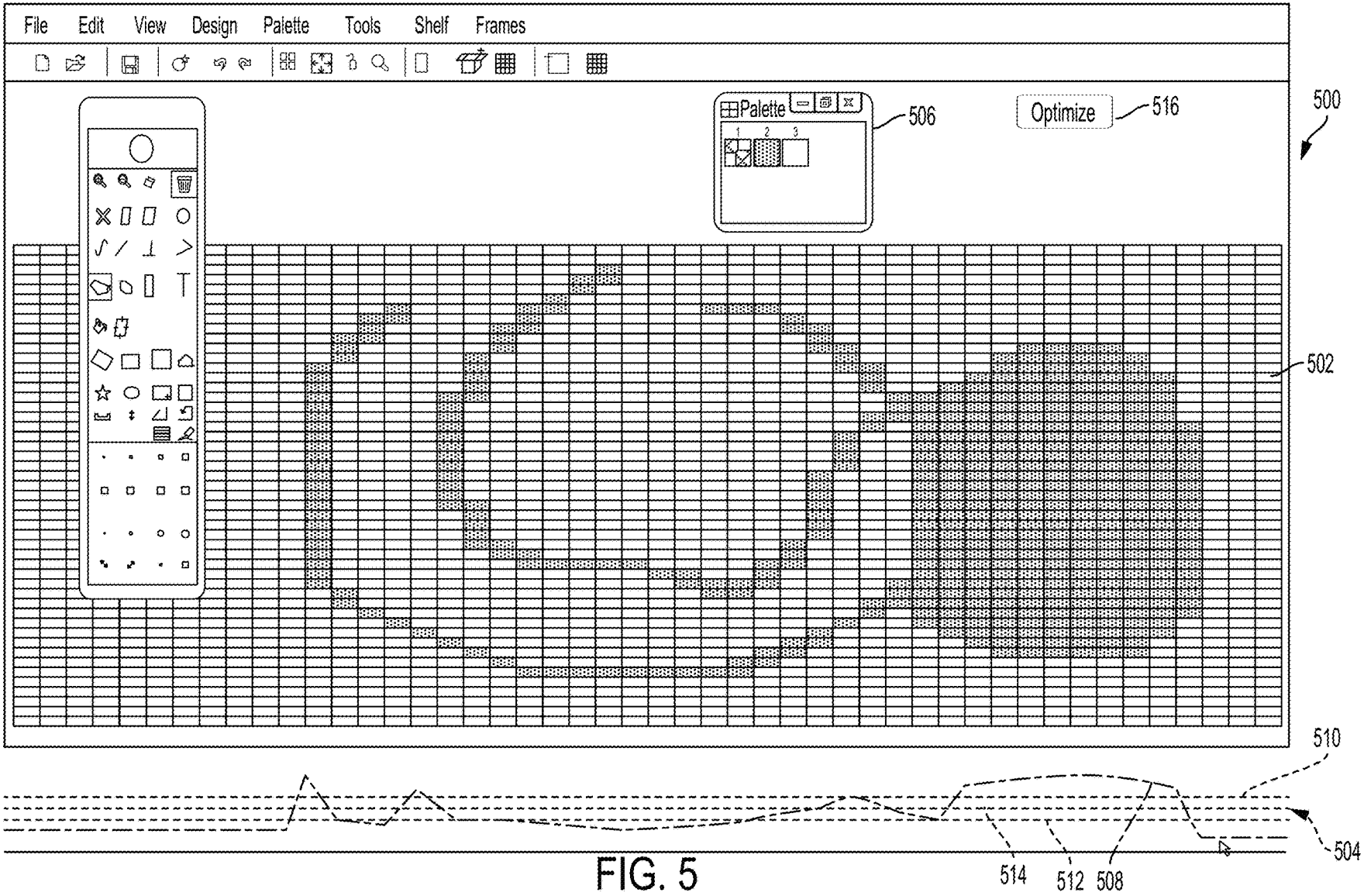
FIG. 5 is a user interface displayed on a display device according to one example of the present disclosure.

FIG. 5 is an example of a user interface 500 according to one aspect. The user interface 500 may be generated by the computing device 102 and viewable on the display device 104 of FIG. 1, or shown via other systems.

The user interface 500 depicts a grid 502 and a graph 504 that are viewable at the same time on a common interface. The grid 502 includes rows and columns of tuft markers. Each tuft marker can correspond to a stitch of a tufting operation. Each column can correspond to one needle among multiple needles that are used in the tufting operation. Commands can be received from an input device that designates the pile height of a tuft marker. In some examples, the grid can be pre-populated with a default pile height for all tuft markers and one or more other pile heights can be designated to certain tuft markers as a designer is working on the pattern design.

For example, in FIG. 5 there is shown a menu 506 with three pile height options. The different pile height options can be selected based on the pattern design and then, in response to further user input or automated input, the selected tuft height can be applied to one or more tuft markers. The different pile height options can be represented by different colors or other visual cues. When a tuft marker is assigned a particular pile height, that tuft marker can reflect the color or other visual cue of the particular pile height. Although three pile-height options are shown in FIG. 5, there can be any number of pile height options that each correspond to a particular pile height or a range of pile heights.

Represented on the graph 504 is the use-of-yarn per needle for a tufting operation. The portion of the graph 504 that is in-line with a particular column of the grid 502 can be linked to that needle and represent the use-of-yarn for the needle associated with that particular column of the grid 502. A use line 508 on the graph 504 can show the relative use-of-yarn among the needles associated with the columns. The graph 504 allows a designer to be aware of the impact that the pattern being designed has on use-of-yarn for a particular operation. Included in the graph 504 of FIG. 5 is a threshold range, represented by an upper bound line 510 and a lower bound line 512, within which it may be desirable to have the use line 508 positioned for all needles to result in a desired use-of-yarn per needle. In some embodiments, an optimal use line 514 is provided between the upper bound line 510 and the lower bound line 512 to indicate the ideal yarn usage, with the upper bound line 510 and the lower bound line 512 representing acceptable deviations from the optimal use line 514. In such embodiments, the designer can strive to create a tuft height design whereby the use line 508 overlies the optimal use line 514.

In the example shown in FIG. 5, portions of the use line 508 is within the threshold range and other portions of the use line 508 are not within the threshold range. The designer can be encouraged to change the design to cause the use line 508 to be flatter and within the threshold range, such that there is an even take-up for the needles in the tufting operation. In response to changes to the pile height of one or more tuft markers on the grid 502, the graph 504 can update substantially contemporaneously with the changes to show the use-of yarn per needle. The pattern designer can have real-time updates as to the use-of-yarn per needle for a particular tuft height pattern design. In some examples, the user interface 500 may display in impact of the pattern design on potential yarn usage of yarn packages of a creel. If the potential yarn usage is not satisfactory to a designer, an optimization algorithm 516 may be used to optimize pile heights of the pattern design such that the yarn usage of the pattern design achieves the even take-up. For example, the optimization algorithm 516 may identify pile height ranges of the pattern design and optimize those pile height ranges to achieve a more accurate even take-up of the yarn packages, as in the process of FIG. 2. In an additional example, the optimization algorithm 516 may use a trained machine-learning model, as in the process of FIG. 4, to generate an updated pattern design that optimizes pile heights for accurate even take-up of the yarn packages.

Figure 6:
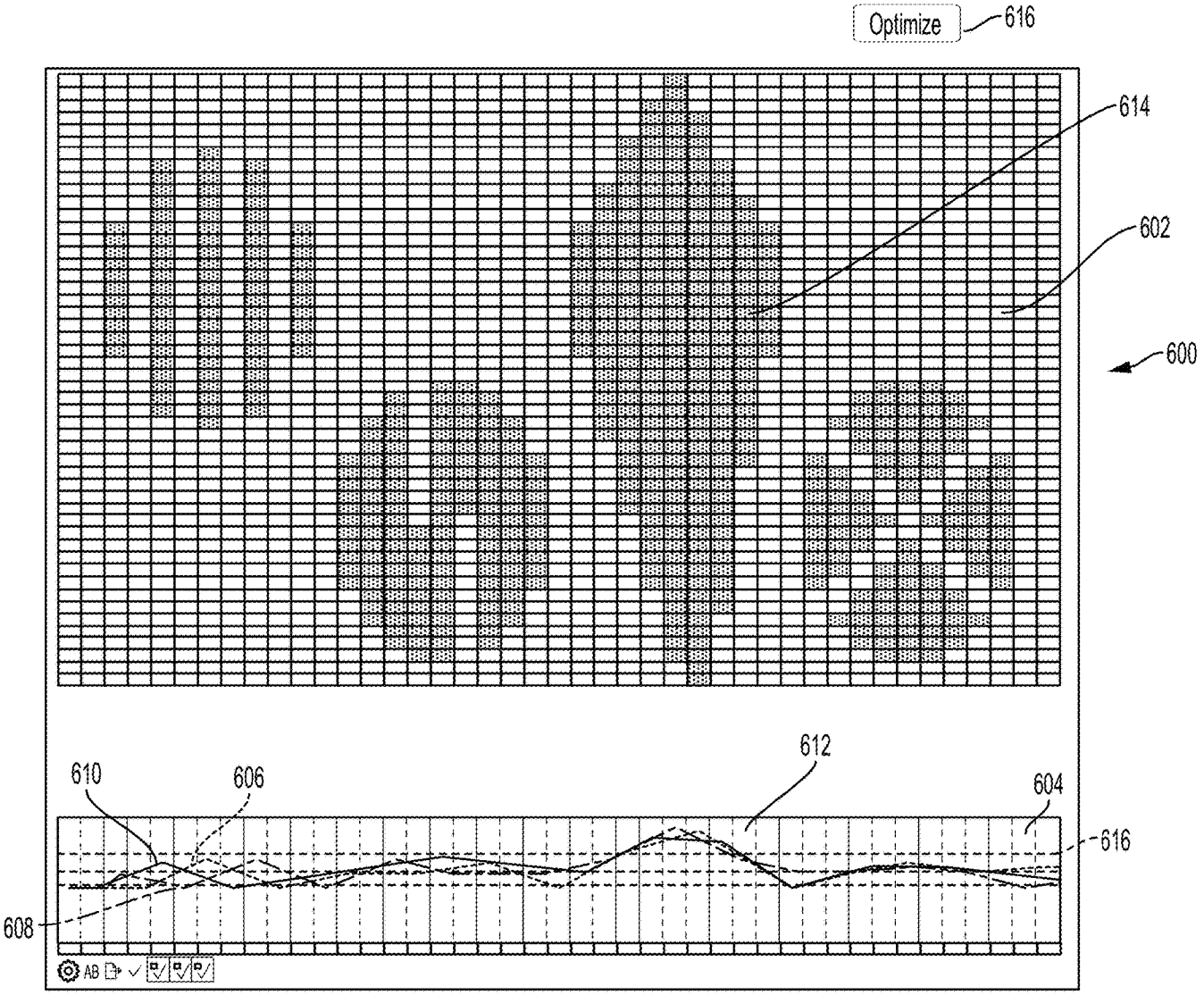
FIG. 6 is a user interface displayed on a display device according to another example of the present disclosure.

FIG. 6 is a user interface 600 according to another example of the present disclosure. The user interface 600 may be generated by the computing device 102 and viewable on the display device 104 of FIG. 1, or shown via other systems.

The user interface 600 shows a grid 602 with a pattern design and a graph 604 showing yarn use per needle on a common interface, similar to the user interface 500 of FIG. 5. The dark portions of the grid 602 represent tufts with high pile heights and the white or lighter portions of the grid 602 represent tufts with low pile heights. The graph 604, however, shows three different use lines 606, 608, 610 that represent use-of-yarn for different colors of yarn for each needle. A designer may include in the pattern design a designation of the color of yarn for each tuft marker. The use lines 606, 608, 610 can be represented with different colors or other line-specific visual cues, but the colors of the use lines 606, 608, 610 may not necessarily represent the color of yarns used in the tufting operation.

And each color of yarn is not necessarily used for each needle. For example, the left-most column of the grid 602 is associated with yarn of a first color represented by use line 606. Another column, however, may be associated with yarn of all three colors represented by the use lines 606, 608, 610. At portion 612 of the graph 604, for example, the part 614 of the pattern of the grid 602 is associated with a very high usage of all three colors as the use lines 606, 608, 610 of all three colors is higher than other parts of the lines and is outside the threshold range 616 of the graph 604.

The visual cues represented in the graph 604 can help a pattern designer create a pattern design so that an even take-up, or close to an even take-up, occurs for every yarn color used in the tufting operation. In other words, the same color of yarn has the same usage such that, for example, all of the blue yarn packages would be identical to all of the other blue yarn packages, all of the yellow yarn packages would be identical to all of the other yellow yarn packages, etc. This can help simplify the yarn package preparation process and significantly reduce the cost of unused yarn per needle for the tufting operation.

Further, upon completion of the pattern design, the designer may select an optimization algorithm 616, similar to the optimization algorithm 516 of FIG. 5, to further achieve even take-up of the yarn packages used in the pattern design. For example, the optimization algorithm 616 may identify pile height ranges of the pattern design and optimize those pile height ranges to achieve a more accurate even take-up of the yarn packages. In an additional example, the optimization algorithm 616 may use a trained machine-learning model, as in the process of FIG. 4, to generate an updated pattern design that optimizes pile heights for accurate even take-up of the yarn packages.

FIG. 7 is chart indicating pile heights of an initial carpet design according to some examples. As depicted, the pile heights vary between 0.4 inches and 0.7 inches, and each column of the chart may depict the tufts generated by an individual needle. As depicted, the initial carpet design generates an uneven distribution of yarn usage across the individual needles. Accordingly, the initial carpet design may not achieve an even take-up of yarn during a tufting operation.

FIG. 8 is a chart indicating optimized pile heights of the initial carpet design of FIG. 7 according to some examples. Because the initial carpet design does not achieve even take-up of the yarn across the individual needles, an optimization algorithm may be applied to the initial carpet design. The optimization algorithm may involve the process described above with respect to FIG. 2. For example, ranges of the pile heights may be identified for the two pile heights. In such an example, the 0.4 inch pile height may have a range identified between 0.3 inches and 0.5 inches. Additionally, the 0.7 inch pile height may have a range identified between 0.6 inches and 0.8 inches. To achieve even take-up of the yarn, the individual pile heights of the chart in FIG. 8 may be adjusted within the identified ranges. Based on the adjustments to the individual pile heights, even take-up of yarn may be achieved across each of the individual needles for the updated carpet design while maintaining the design integrity of the initial carpet design.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The invention claimed is:

1. A method, comprising:

accessing an electronic representation of a pattern design for controlling a carpet tufting operation, the pattern design including a pile height per tuft;

determining ranges of a plurality of pile heights identified in the pattern design;

determining individual pile heights of the plurality of pile heights of the pattern design using the ranges of the plurality of pile heights to manage even take-up of two or more tuft material packages; and modifying the pattern design with each of the individual pile heights.

2. The method of claim 1, wherein determining the individual pile heights is performed by an optimization algorithm to achieve even take-up of yarn packages of the carpet tufting operation.

3. The method of claim 1, further comprising:

controlling the carpet tufting operation using the modified pattern design.

4. The method of claim 1, wherein determining the individual pile heights further comprises:

identifying a first pile from the pattern design comprising a first assigned pile height;

identifying a second pile from the pattern design comprising the first assigned pile height;

assigning a first modified pile height to the first pile, the first modified pile height within a first range of the ranges of the plurality of pile heights; and assigning a second modified pile height that is different from the first modified pile height to the second pile, the second modified pile height within the first range of the ranges of the plurality of pile heights.

5. The method of claim 1, wherein the ranges of the plurality of pile heights of the pattern design comprise at least three non-overlapping ranges of pile heights.

6. The method of claim 1, wherein the ranges of the plurality of pile heights comprise a first range and a second range, wherein the first range comprises a larger range of pile heights than the second range.

7. The method of claim 1, further comprising:

accessing update data from prior updates to prior pattern designs, the update data comprising at least the individual pile heights of the plurality of pile heights of the pattern design;

training, using the update data, a machine-learning model to generate updated pattern designs;

accessing an electronic representation of a new pattern design for controlling a carpet tufting operation, the new pattern design including a new pile height per tuft; and generating an updated new pattern design by applying the trained machine-learning model to the new pattern design, the updated new pattern design including an updated new pile height per tuft.

8. A non-transitory, computer-readable medium having program instructions that are executable by a processor for performing operations, the operations comprising:

accessing update data from prior updates to prior pattern designs;

training, using the update data, a machine-learning model to generate updated pattern designs;

accessing an electronic representation of a new pattern design for controlling a carpet tufting operation, the new pattern design including a pile height per tuft; and generating an updated new pattern design by applying the trained machine-learning model to the new pattern design, the updated new pattern design including an updated pile height per tuft.

9. The non-transitory, computer-readable medium of claim 8, wherein the updated pile height per tuft of the updated new pattern design provides even take-up of yarn packages of the carpet tufting operation.

10. The non-transitory, computer-readable medium of claim 8, wherein the operations further comprise:

controlling the carpet tufting operation using the updated new pattern design.

11. The non-transitory, computer-readable medium of claim 8, wherein the updated new pattern design comprises (1) a first modified pile height assigned to a first pile, the first modified pile height within a first range of a plurality of ranges of pile heights of the new pattern design and (2) a second modified pile height that is different from the first modified pile height and assigned to a second pile, the second modified pile height within the first range of the plurality of ranges of the pile heights.

12. The non-transitory, computer-readable medium of claim 8, wherein the machine-learning model comprises a supervised or semi-supervised machine-learning model that is trained for application to future pattern designs to select pile heights that achieve even take-up of yarn packages of a creel while maintaining design integrity.

13. The non-transitory, computer-readable medium of claim 8, wherein the update data comprises a plurality of pile heights of a prior pattern design, wherein the plurality of pile heights fall within identified ranges of the prior pattern design, and wherein the identified ranges comprise at least three non-overlapping ranges of pile heights.

14. A system comprising:

a processor; and a memory device having program instructions that are executable by the processor to perform operations comprising:

accessing an electronic representation of a pattern design for controlling a carpet tufting operation, the pattern design including a pile height per tuft;

determining ranges of a plurality of pile heights identified in the pattern design;

determining individual pile heights of the plurality of pile heights of the pattern design using the ranges of the plurality of pile heights to manage even take-up of two or more tuft material packages; and modifying the pattern design with each of the individual pile heights.

15. The system of claim 14, wherein the operations further comprise:

accessing update data from prior updates to prior pattern designs, the update data comprising at least the individual pile heights of the plurality of pile heights of the pattern design;

training, using the update data, a machine-learning model to generate updated pattern designs;

accessing an electronic representation of a new pattern design for controlling a carpet tufting operation, the new pattern design including a new pile height per tuft; and generating an updated new pattern design by applying the trained machine-learning model to the new pattern design, the updated new pattern design including an updated new pile height per tuft.

16. The system of claim 14, wherein the operation of determining the individual pile heights is performed by an optimization algorithm to achieve even take-up of yarn packages of the carpet tufting operation.

17. The system of claim 14, the operations further comprising:

controlling the carpet tufting operation using the modified pattern design.

18. The system of claim 14, wherein the operation of determining the individual pile heights further comprises:

identifying a first pile from the pattern design comprising a first assigned pile height;

identifying a second pile from the pattern design comprising the first assigned pile height;

assigning a first modified pile height to the first pile, the first modified pile height within a first range of the ranges of the plurality of pile heights; and assigning a second modified pile height that is different from the first modified pile height to the second pile, the second modified pile height within the first range of the ranges of the plurality of pile heights.

19. The system of claim 14, wherein the ranges of the plurality of pile heights of the pattern design comprise at least three non-overlapping ranges of pile heights.

20. The system of claim 14, wherein the ranges of the plurality of pile heights comprise a first range and a second range, wherein the first range comprises a larger range of pile heights than the second range.

* * * * *